US012460625B2

(12) United States Patent
Dorin et al.

(10) Patent No.: US 12,460,625 B2
(45) Date of Patent: Nov. 4, 2025

(54) REDUCED HEAT EXCHANGE RECIPROCATING COMPRESSOR

(71) Applicant: OFFICINE MARIO DORIN S.P.A., Florence (IT)

(72) Inventors: Mario Dorin, Pontassieve (IT); Giulio Lenzi, Florence (IT)

(73) Assignee: OFFICINE MARIO DORIN S.P.A., Fiesole (IT)

( * ) Notice: Subject to any disclaimer, the term of this patent is extended or adjusted under 35 U.S.C. 154(b) by 0 days.

(21) Appl. No.: 18/637,780

(22) Filed: Apr. 17, 2024

(65) Prior Publication Data

US 2025/0084839 A1 Mar. 13, 2025

(30) Foreign Application Priority Data

Sep. 13, 2023 (IT) ..... 102023000018771

(51) Int. Cl.

| | |
|---|---|
| ***F04B 39/12*** | (2006.01) |
| ***F04B 39/06*** | (2006.01) |
| ***F04B 53/00*** | (2006.01) |
| ***F04B 53/16*** | (2006.01) |

(52) U.S. Cl.

CPC ..... *F04B 39/128* (2013.01); *F04B 39/066* (2013.01); *F04B 39/125* (2013.01); *F04B 53/007* (2013.01); *F04B 53/16* (2013.01)

(58) Field of Classification Search

CPC .... F04B 39/125; F04B 39/128; F04B 39/066; F04B 53/007; F04B 53/16

See application file for complete search history.

(56) References Cited

U.S. PATENT DOCUMENTS

| | | | | | |
|---|---|---|---|---|---|
| 1,476,794 | A * | 12/1923 | Berry | F16K 15/1402 | 417/571 |
| 1,714,836 | A * | 5/1929 | Aikman | F04B 39/125 | 417/432 |
| 1,764,753 | A * | 6/1930 | Seagren | F04B 25/005 | 92/144 |
| 1,870,219 | A * | 8/1932 | Aikman | F04B 39/062 | 417/419 |
| 2,162,082 | A * | 6/1939 | Hazen | F02F 1/4214 | 123/41.74 |
| 2,449,408 | A * | 9/1948 | Naab | F04B 39/064 | 137/340 |
| 4,529,365 | A * | 7/1985 | Schutt | F04B 39/066 | 417/372 |
| 4,536,132 | A * | 8/1985 | Tenney | F04B 41/02 | 165/122 |
| 5,584,675 | A * | 12/1996 | Steurer | F04B 39/066 | 417/372 |
| 11,441,552 | B2 * | 9/2022 | Burkauskas | F04B 39/06 | |
| 12,241,665 | B2 * | 3/2025 | Inaba | F04B 41/06 | |

(Continued)

FOREIGN PATENT DOCUMENTS

| | | |
|---|---|---|
| CN | 112555126 A | 3/2021 |
| CN | 114738230 A | 7/2022 |

(Continued)

*Primary Examiner* — Christopher S Bobish

(74) *Attorney, Agent, or Firm* — Maschoff Brennan

(57) ABSTRACT

A reciprocating compressor with a head-holding turret in the upper portion of which one or more recesses, open to the outside, are defined, which reduce as much as possible the contact surface with the valve carrier plate above.

10 Claims, 4 Drawing Sheets

(56) References Cited

U.S. PATENT DOCUMENTS

| | | | | |
|---|---|---|---|---|
| 2020/0386143 | A1 | 12/2020 | Huffman et al. | |
| 2021/0180582 | A1 * | 6/2021 | Burkauskas | F04B 39/06 |

FOREIGN PATENT DOCUMENTS

| | | | | |
|---|---|---|---|---|
| EP | 3 734 073 | A1 | 11/2020 | |
| FR | 1257735 | A * | 4/1961 | |
| WO | WO-2019015855 | A1 * | 1/2019 | F04B 39/06 |

* cited by examiner

REDUCED HEAT EXCHANGE RECIPROCATING COMPRESSOR

TECHNICAL FIELD

The present invention belongs to the technical field of reciprocating piston compressors used in the refrigeration and heat pump industry as well as more generally in the fields of commerce, industry, transportation, process cooling, etc.

More specifically, the present invention relates to a reciprocating compressor of the type preferably used with closed-type refrigeration circuits, of the type that draws in a refrigerant fluid in gas phase and compresses it into a refrigerant circuit in which the gas expands and then re-enters the compressor at a lower pressure.

The present invention is specially applied in the field of both transcritical and subcritical carbon dioxide compressors.

Specifically, the present invention focuses on the aspects inherent to the diffusion and dissipation of the heat generated by the action of compressing the gas.

PRESENT STATUS OF THE ART

In general, inside reciprocating compressors, a low-pressure portion is identified, i.e., the suction pressure of the gas inside the machine, and a high-pressure portion, i.e., the delivery pressure of the refrigerant fluid, which has been compressed by the pistons inside the cylinders and is fed into the refrigerant circuit; it should be noted that in the present patent text the expression "refrigerant circuit" or "refrigeration circuit" means collectively the set of piping and equipment in which a refrigerant fluid discharged from the compressor is circulated. Hereafter this term will refer to both refrigeration circuits as such and heat pump circuits.

The configuration of reciprocating compressors generally includes a crankcase inside of which are housed the cylinders, the crankshaft with connecting rods and pistons, as well as the lubrication system; very often the electric motor that drives the compressor is also housed inside the crankcase. Generally, in this type of compressors, the upper part of the cylinders is closed by a valve carrier plate to which are attached the reed valves that open and close the inlet and exhaust ports of the cylinders. Above the valve plate is the compressor head, which includes the inlet and delivery chambers. In correspondence with the head on the crankcase rises a head-holding turret, inside of which the cylinders are defined.

In small commercial-type compressors, the two chambers are defined within the same head and are subdivided by a bulkhead; this architecture has established itself for several reasons: one reason is that making a single head with two chambers is less expensive than it would be to make two heads each with only one chamber; another reason is related to the fact that in this way the number of seals, which are always a source of potential refrigerant gas leakage, is reduced; finally, it must also be kept in mind that in small compressors it would not always be possible to find the necessary space for all the screws that would be needed to attach two heads to the crankcase instead of only one.

Normally, compressors of this type are configured so that the cold gas flow is routed through the crankcase by lapping and/or passing through the electric motor to cool it and to separate from the refrigerant the lubricating oil, which falls back into the lower portion of the crankcase, then the flow of cold gas crosses the valve carrier plate from down to up and reaches the intake chamber, where it makes a turn to descend into the cylinder during the intake phase, passing through the reed valve, moving by virtue of the pressure difference caused by the descent of the piston to the bottom dead center.

The delivery chamber is the portion of the compressor at the highest temperature because the gas has been heated by the compression action exerted by the pistons; in machines that compress carbon dioxide, this phenomenon is particularly pronounced because the compressed gas can reach particularly high temperatures, even in the range of 150° C.

As a result, a major portion of the thermal energy is transferred from the compressed gas to the walls of the delivery chamber and from these is transferred to the head-holding turret and crankcase, thus raising the temperature of the entire compressor, with the unfortunate consequence of heating the gas, expanding it and reducing the amount of mass that is drawn into the cylinder, thus decreasing the efficiency of the compressor.

To reduce compressor heating resulting from heat transfer from the delivery chamber over time, several configurations have been developed, aimed at increasing heat dissipation through convection to the surrounding atmosphere.

Specifically, according to the state of the art, at least one groove is defined in the upper portion of the head-holding turret, which is closed at the top by the valve carrier plate when the compressor is assembled. The function of the groove is to transfer heat by convection to the atmospheric air passing through it.

Normally, the crankcase of compressors of this type is made by casting, pouring spheroidal cast iron in appropriate molds. This makes it necessary to realize the groove by excavating the casting with a machine tool that works by chip removal, since it would not be possible to obtain the groove directly through casting because of the need to provide for draft angles that would impose dimensions greater than those available in the head-holding turret. These considerations must take into account the presence of the threaded holes into which the head clamping screws are screwed, these screws are subjected to significant tensile stresses and therefore their nutscrews must be able to absorb these stresses by transferring them to the head-holding turret.

OBJECTS AND SUMMARY OF THE INVENTION

In the field of reciprocating compressors, and in particular in the field of reciprocating compressors working with carbon dioxide as the refrigerant fluid, the need is felt to reduce the heating of the compressor housing as much as possible, to prevent the compressor in turn from transferring heat to the cold fluid passing through it directed toward the cylinders.

At the same time, the need is felt not to increase the manufacturing cost, weight, and overall dimensions of the compressor.

The objective of the present invention is therefore to provide a reciprocating compressor in which the temperature differential of the cold gas between the inlet into the compressor and the inlet into the cylinder is less than the temperature rise that occurs in compressors of known art when other characteristics such as displacement, number of cylinders, crankshaft speed, compression ratio, etc., are equal.

A further objective of the present invention is to provide a more efficient and less expensive device than compressors built according to the known art.

These and other objectives, which will be clear to the expert in the field from reading the present text, are achieved by means of a device comprising a crankcase made from a casting of spheroidal cast iron, in the upper portion of which one or more recesses are defined, below the valve carrier plate and in correspondence with the delivery chamber defined within the head.

Said recesses are made by casting and are configured to minimize the contact areas between the upper portion of the crankcase and the valve carrier plate, in fact minimizing the metal around the cylinders and the threaded bushings for fastening the head clamping screws.

The applicant's research and experimental activities have shown that the heating of the crankcase, and consequently of the compressor, are primarily a consequence of conduction heat exchange occurring between the delivery head and the upper face of the crankcase. For this reason, the scope of the recesses is not to provide a passage for air, but is to reduce the contact areas.

The same inventive concept is applicable both to reciprocating compressors with the motor outside the crankcase, also known as open compressors, and to reciprocating compressors with the motor integrated inside the crankcase, known as semi-hermetic or hermetic compressors.

The invention is more efficient than the known art in terms of reducing heat transfer between the header and the compressor body, and in addition, the casting construction technology is much faster and more economical than machining by chip removal.

DETAILED DESCRIPTION OF AN EMBODIMENT OF THE INVENTION

Figure 1:
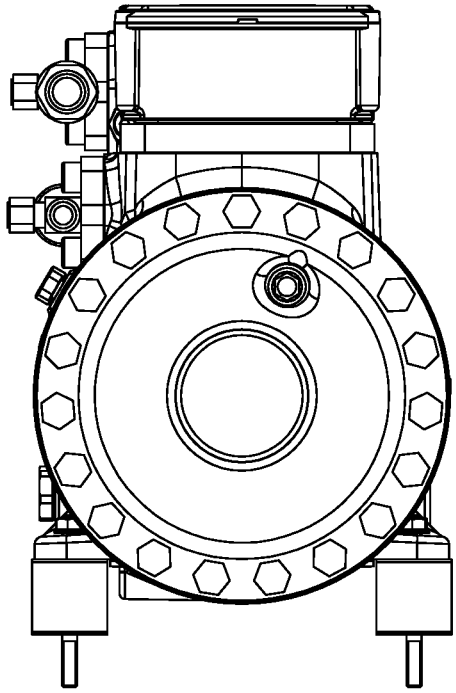
FIG. 1 shows a view of the compressor from the motor side.
Figure 2:
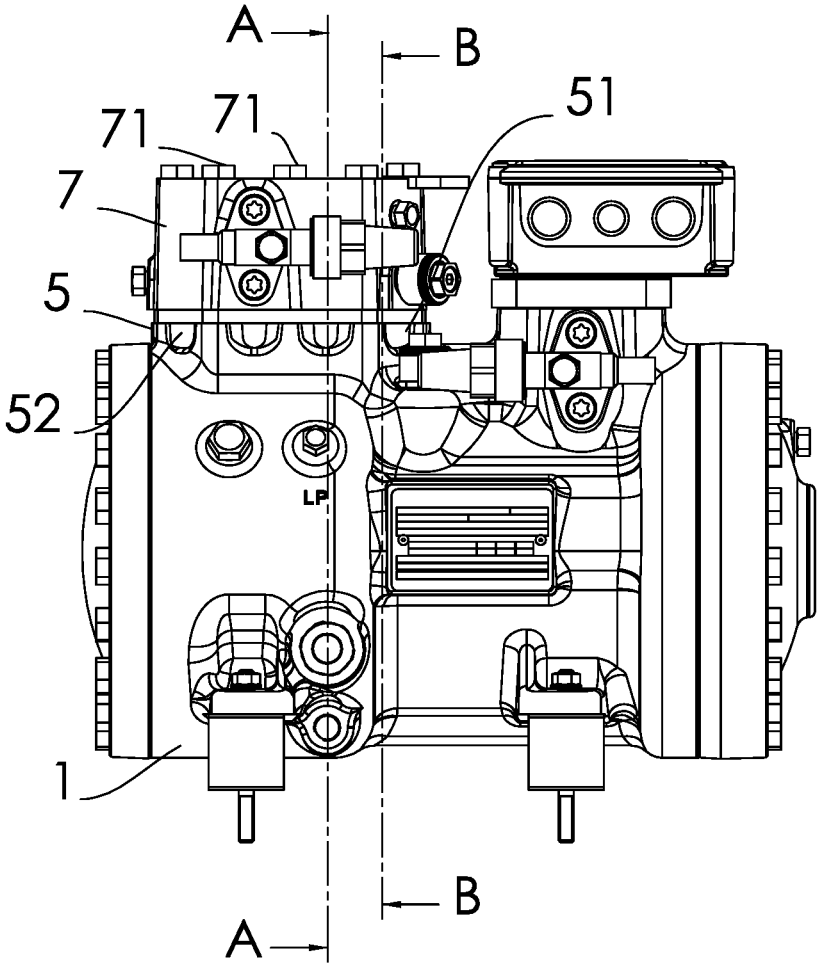
FIG. 2 shows a view of the compressor from the nameplate side.
Figure 3:
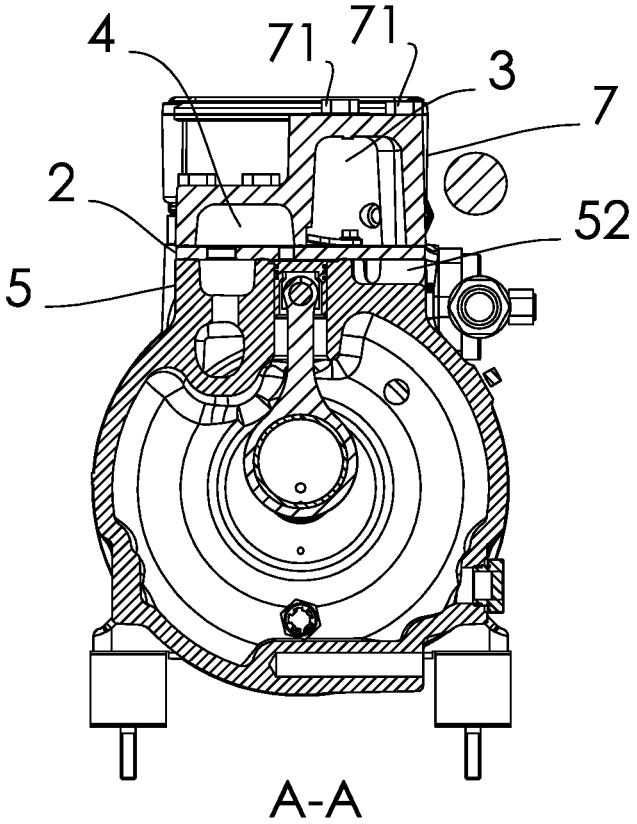
FIG. 3 shows a first cross section (A-A) of the compressor.
Figure 4:
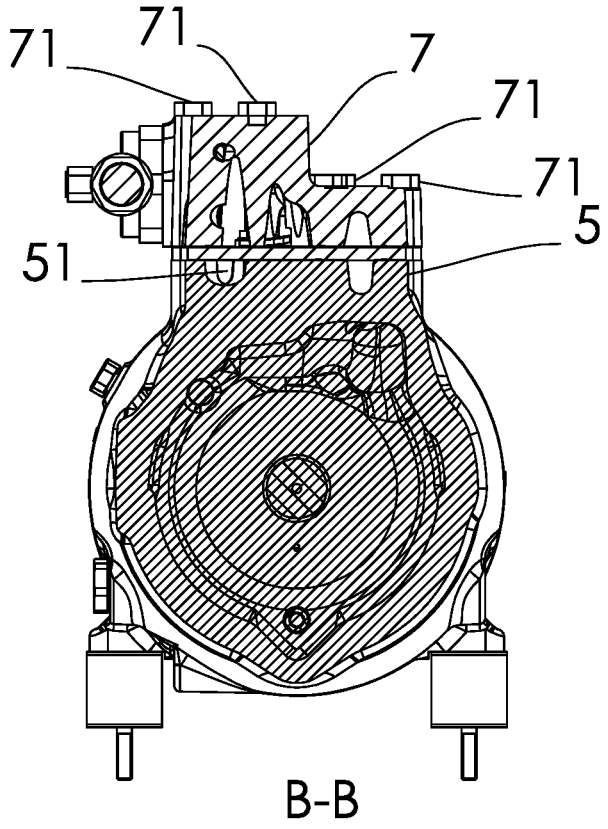
FIG. 4 shows a second cross section (B-B) of the compressor.
Figure 5:
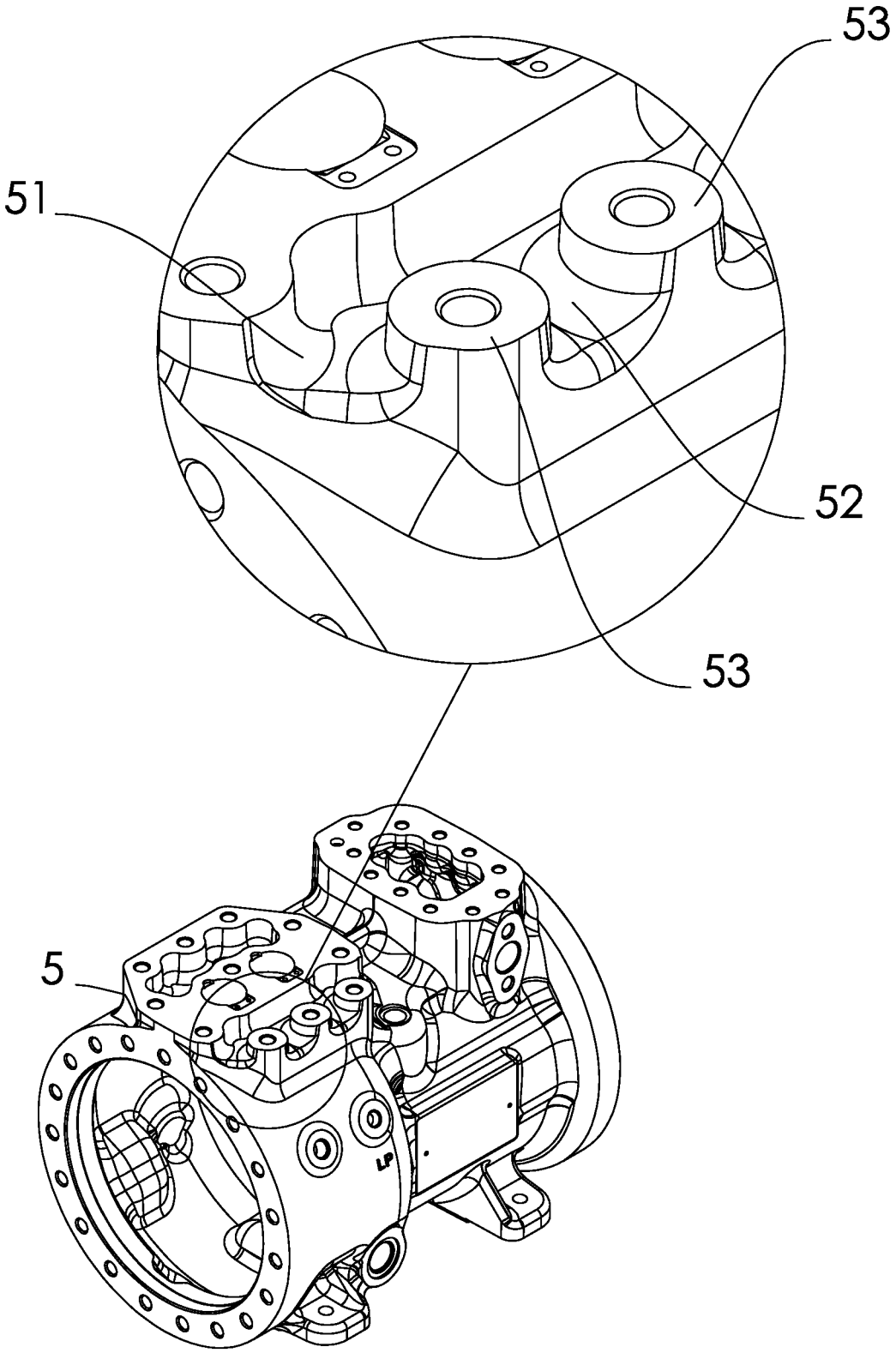
FIG. 5 shows a perspective view of the compressor crankcase, with an enlargement of the recesses.
Figure 6:
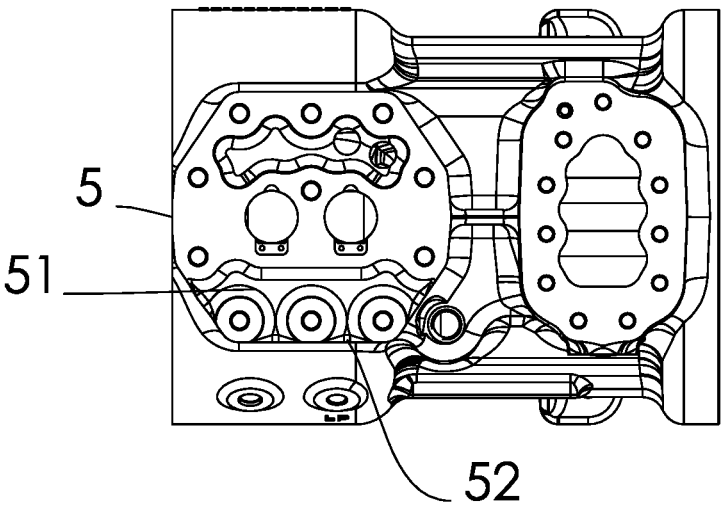
FIG. 6 shows a top view of the compressor crankcase.

In the embodiment shown in the attached figures, the device that is the subject of the present invention comprises a crankcase (1) in which is housed an electric motor that puts in rotation a crankshaft to which are rotationally connected connecting rods each of which makes a piston slide inside the respective cylinder. It should be noted that the term crankshaft is used to refer to any embodiment typical of crank mechanisms that transform the rotary motion of a shaft into the reciprocating motion of pistons sliding inside cylinders, e.g., an eccentric shaft.

The upper part of the cylinders is closed by a valve carrier plate (2) above which is the head (7) in which the delivery chamber (3), which receives the high-pressure hot fluid, and the suction chamber (4), which receives the low-pressure cold fluid, are defined.

At least one inlet port and one exhaust port are defined in the valve carrier plate, which are opened and closed by respective reed valves.

At one end of the crankcase stands a head-holding turret (5), inside of which the cylinders are defined and above which is the valve carrier plate (2); above the latter is the head (7).

In the portion of the head-holding turret in which the cylinders are not defined, a longitudinal recess (51) is defined, extending parallel to the axis of rotation of the compressor, the ends of which lead to a respective transverse face of the head-holding turret, and a plurality of transverse recesses (52) are also defined, which have a first inner end that leads to the longitudinal recess (51) and a second outer end that leads to the longitudinal face of the head-holding turret that is on the side opposite to that of the cylinders.

The head (7) is made integral with the head-holding turret (5) by means of a plurality of clamping screws (71); a portion of the clamping screws engage in respective threaded bushings (53) that rise from the head-holding turret (5) and are interspersed with said transverse recesses (52), while the longitudinal recess (51) separates them from the portion of the head-holding turret (5) in which the cylinders are defined.

Conveniently, the crankcase (1) is made from a spheroidal cast iron casting molded into a form including a core conformed in such a way as to define said recesses (51, 52) directly in the cast, without the need for further machining with machine tools for chip removal.

The invention claimed is:

1. A reciprocating piston compressor, comprising:

a crankcase that has an upper portion and houses therein a crankshaft, set in rotation by an engine, the crankshaft driving, by means of connecting rods, one or more pistons that slide within respective cylinders, above which is a valve carrier plate having a lower face, in said valve carrier plate, for each cylinder, there is defined at least one inlet port, closed by an inlet valve, and at least one exhaust port, also closed by its own exhaust valve, said compressor having an axis of rotation corresponding to the axis of rotation of said crankshaft, wherein:

the upper portion of said crankcase being below said valve carrier plate rises to form a head-holding turret on which said valve carrier plate rests, on the latter being located a head, reversibly connected to the upper portion of said head-holding turret by means of a plurality of clamping screws, said head-holding turret comprising two transverse faces and a longitudinal face that is on the side opposite to that of the cylinders, in said head being defined a delivery chamber and an intake chamber placed, respectively, in correspondence with said exhaust valve and said inlet valve, and in the upper portion of said head-holding turret, in correspondence with said delivery chamber, one or more recesses are defined below said valve carrier plate, wherein at least one of said one or more recesses opens to the outside and is directly accessible to the outside air, wherein, in the upper portion of said head-holding turret, there is defined a first longitudinal recess that crosses said head-holding turret extending parallel to the axis of rotation of the compressor and the ends of which open onto the two transverse faces of said head-holding turret, respectively.

2. The compressor according to claim 1, wherein one or more transverse recesses are defined in the upper portion of said head-holding turret, each having a first outer end that leads to the longitudinal face of the head-holding turret that is on the side opposite to that of the cylinders and a second inner end that leads to said longitudinal recess.

3. The compressor according to claim 2, wherein at least a portion of the clamping screws engages in respective threaded bushings rising from said head-holding turret.

4. The compressor according to claim 3, wherein said threaded bushings are interspersed with said transverse recesses, while the longitudinal recess separates them from the portion of the head-holding turret in which the cylinders are defined.

5. The compressor according to claim 4, wherein said crankcase is formed from a casting of spheroidal cast iron in which said recesses are already defined.

6. The compressor according to claim 1, wherein said one or more recesses extend horizontally to reduce as much as possible the contact between the upper portion of said head-holding turret and the lower face of said valve carrier plate.

7. The compressor according to claim 6, wherein one or more transverse recesses are defined in the upper portion of said head-holding turret, each having a first outer end that leads to the longitudinal face of the head-holding turret that is on the side opposite to that of the cylinders and a second inner end that leads to said longitudinal recess.

8. The compressor according to claim 7, wherein at least a portion of the clamping screws engages in respective threaded bushings rising from said head-holding turret.

9. The compressor according to claim 8, wherein said threaded bushings are interspersed with said transverse recesses, while the longitudinal recess separates them from the portion of the head-holding turret in which the cylinders are defined.

10. The compressor according to claim 9, wherein said crankcase is formed from a casting of spheroidal cast iron in which said recesses are already defined.

* * * * *